US009718634B2

(12) United States Patent
Kambayashi

(10) Patent No.: US 9,718,634 B2
(45) Date of Patent: Aug. 1, 2017

(54) SHEET THICKNESS DETECTOR, SHEET CONVEYOR INCORPORATING SAME, AND IMAGE FORMING APPARATUS INCORPORATING SAME

(71) Applicant: Mamoru Kambayashi, Tokyo (JP)

(72) Inventor: Mamoru Kambayashi, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/296,558

(22) Filed: Jun. 5, 2014

(65) Prior Publication Data

US 2015/0008640 A1 Jan. 8, 2015

(30) Foreign Application Priority Data

Jul. 4, 2013 (JP) ..... 2013-140852

(51) Int. Cl.
*B65H 5/02* (2006.01)
*B65H 5/04* (2006.01)
(Continued)

(52) U.S. Cl.
CPC ..... *B65H 7/02* (2013.01); *B65H 5/062* (2013.01); *B65H 2404/1321* (2013.01);
(Continued)

(58) Field of Classification Search
CPC ..... B65H 2404/142; B65H 2404/144; B65H 2404/152; B65H 2553/00; B65H 2553/20;
(Continued)

(56) References Cited

U.S. PATENT DOCUMENTS 5,029,837 A * 7/1991 Uchiyama ..... B65H 7/12 271/110
5,507,482 A * 4/1996 Tenpaku ..... B65H 9/166 271/251
(Continued)

FOREIGN PATENT DOCUMENTS

DE EP 2865626 A1 * 4/2015 ..... B65H 29/12
JP 2008-254855 10/2008
(Continued)

*Primary Examiner* — Prasad Gokhale
(74) *Attorney, Agent, or Firm* — Harness, Dickey & Pierce, P.L.C.

(57) ABSTRACT

A sheet thickness detector incorporated in a sheet conveyor and/or an image forming apparatus includes multiple first rollers aligned in a direction perpendicular to a sheet conveying direction, multiple second rollers facing the respective first rollers, a first roller shaft supporting two first rollers, at least one second roller shaft supporting rollers other than the two first rollers, at least one third roller shaft to support at least three second rollers, a first roller shaft holder supporting the first roller shaft to move from the at least one third roller shaft in a contact/separation direction, a biasing member biasing the first roller shaft toward at least one third roller shaft, and a displacement amount detector detecting an amount of displacement of the first roller shaft. A thickness of a sheet between the first and second rollers is detected based on a detection result by the displacement amount detector.

15 Claims, 4 Drawing Sheets

(51) Int. Cl.
*B65H 7/02* (2006.01)
*B65H 5/06* (2006.01)

(52) U.S. Cl.
CPC ..... *B65H 2404/144* (2013.01); *B65H 2404/1431* (2013.01); *B65H 2511/13* (2013.01); *B65H 2511/224* (2013.01)

(58) Field of Classification Search
CPC ..... B65H 2553/25; B65H 2553/40; B65H 2553/41; B65H 2553/412; B65H 2553/414; B65H 2553/60; B65H 2553/61; B65H 2553/612; B65H 2553/614; B65H 2511/224
USPC ..... 271/273, 274, 265.01, 265.04, 258.01, 271/262, 263
See application file for complete search history.

(56) References Cited

U.S. PATENT DOCUMENTS 6,141,883 A * 11/2000 Mitchell ..... B65H 43/00 271/274
7,817,957 B2 * 10/2010 Oohara ..... B65H 7/12 271/258.01
8,177,229 B2 * 5/2012 Ledgerwood ..... B65H 5/062 271/271
8,328,192 B2 * 12/2012 Yamazaki ..... B65H 7/02 271/262
8,950,750 B2 * 2/2015 Wakabayashi ..... B65H 7/12 271/262
2005/0280205 A1 * 12/2005 Knierim ..... B65H 7/02 271/265.04
2005/0280206 A1 * 12/2005 Ahn ..... B65H 5/06 271/273
2007/0018383 A1 * 1/2007 Ohara ..... B65H 7/12 271/262
2008/0247797 A1 * 10/2008 Yoshino ..... B65H 29/12 399/406
2010/0170770 A1 * 7/2010 Abraham ..... B65H 5/062 198/624
2010/0301551 A1 * 12/2010 Muranaka ..... B65H 7/12 271/265.04
2011/0049801 A1 * 3/2011 deJong ..... B65H 5/062 271/274
2011/0210506 A1 * 9/2011 Yamazaki ..... B65H 7/02 271/265.04
2012/0119432 A1 5/2012 Kambayashi et al.
2013/0187334 A1 * 7/2013 Kimura ..... B65H 29/70 271/314
2013/0200565 A1 * 8/2013 Takenaka ..... B65H 5/062 271/273
2013/0241141 A1 * 9/2013 Karikusa ..... B65H 9/00 271/227
2014/0015192 A1 * 1/2014 Wakabayashi ..... B65H 7/12 271/110

FOREIGN PATENT DOCUMENTS

JP 2012-166913 9/2012
JP 2014-031275 2/2014

* cited by examiner

SHEET THICKNESS DETECTOR, SHEET CONVEYOR INCORPORATING SAME, AND IMAGE FORMING APPARATUS INCORPORATING SAME

CROSS-REFERENCE TO RELATED APPLICATIONS

This patent application is based on and claims priority pursuant to 35 U.S.C. §119(a) to Japanese Patent Application No. 2013-140852, filed on Jul. 4, 2013 in the Japan Patent Office, the entire disclosure of which is hereby incorporated by reference herein.

BACKGROUND

Technical Field

Embodiments of the present invention relate to a sheet thickness detector, a sheet conveyor incorporating the sheet thickness detector, and an image forming apparatus incorporating the sheet thickness detector therein.

Related Art

Known image forming apparatuses generally form an image on a surface of a sheet during a sheet conveying operation. To obtain a high-quality image, image forming conditions are optimized according to different thicknesses of various types of sheets. For example, in a transfer process to transfer a toner image onto the sheet, a variety of sheet thicknesses has different volume resistance values in a transfer area. Due to the differences of the volume resistance values, an optimal transfer current value varies. Therefore, it is preferable to change the transfer current value according to the sheet thickness. Further, in a fixing process to fix the toner image transferred onto the surface of the sheet to the sheet by application of heat and pressure, different amounts of heat are applied to respective sheet thicknesses. Therefore, it is preferable to change a fixing temperature according to the sheet thickness.

Japanese Patent Application Publication No. JP 2012-166913-A discloses an image forming apparatus that includes a sheet thickness detector disposed in a sheet conveying path to detect a thickness of a sheet to be conveyed.

In Japanese Patent Application Publication No. JP 2012-166913-A, when a sheet enters between drive rollers and driven rollers, the driven rollers are pushed up due to the thickness of the sheet or sheet thickness. Accordingly, the position of a driven roller shaft is displaced to a direction to separate from the drive roller shaft. This amount of displacement of the driven roller shaft is detected by a displacement sensor that is disposed in contact with the driven roller shaft. According to the detection result obtained by the displacement sensor, a controller determines the sheet thickness.

However, due to nonuniformity in diameter of the drive rollers and the driven rollers, a gap is generated between the drive rollers and the driven rollers. The gap can cause variation in displacement amounts of the driven roller shaft. Consequently, a highly accurate sheet thickness detection cannot be performed. To detect and determine different sheet thicknesses accurately, a significant increase in cost for reducing allowable tolerance of a diameter of a roller is unavoidable.

SUMMARY

At least one embodiment of the present invention provides a sheet thickness detector including multiple first rollers aligned in a direction perpendicular to a sheet conveying direction, multiple second rollers disposed facing the respective multiple first rollers, a first roller shaft to support two first rollers of the multiple first rollers, at least one second roller shaft to support rollers other than the two first rollers of the multiple first rollers, at least one third roller shaft to support at least three second rollers of the multiple second rollers, a first roller shaft holder to support the first roller shaft to move from the at least one third roller shaft in a contact/separation direction, a biasing member to bias the first roller shaft toward the at least one third roller shaft in the contact/separation direction, and a displacement amount detector to detect an amount of displacement of the first roller shaft in the contact/separation direction. A thickness of a sheet held between the multiple first rollers and the multiple second rollers is detected based on a detection result obtained by the displacement amount detector.

Further, at least one embodiment of the present invention provides a sheet conveyor including a conveying force applier to apply a conveying force to a sheet, the above-described sheet thickness detector to detect the thickness of the sheet conveyed with the conveying force applied by the conveying force applier, and a controller to control a sheet conveying operation according to a detection result obtained by the sheet thickness detector.

Further, at least one embodiment of the present invention provides an image forming apparatus including an image forming device to form an image on a sheet, a conveying force applier to apply a conveying force to the sheet that receives the image formed by the image forming device, the above-described sheet thickness detector to detect the thickness of the sheet conveyed with the conveying force applied by the conveying force applier, and a controller to control a sheet conveying operation according to a detection result obtained by the sheet thickness detector.

BRIEF DESCRIPTION OF THE DRAWINGS

A more complete appreciation of the invention and many of the advantages thereof will be obtained as the same becomes better understood by reference to the following detailed description when considered in connection with the accompanying drawings, wherein.

DETAILED DESCRIPTION

Figure 1:
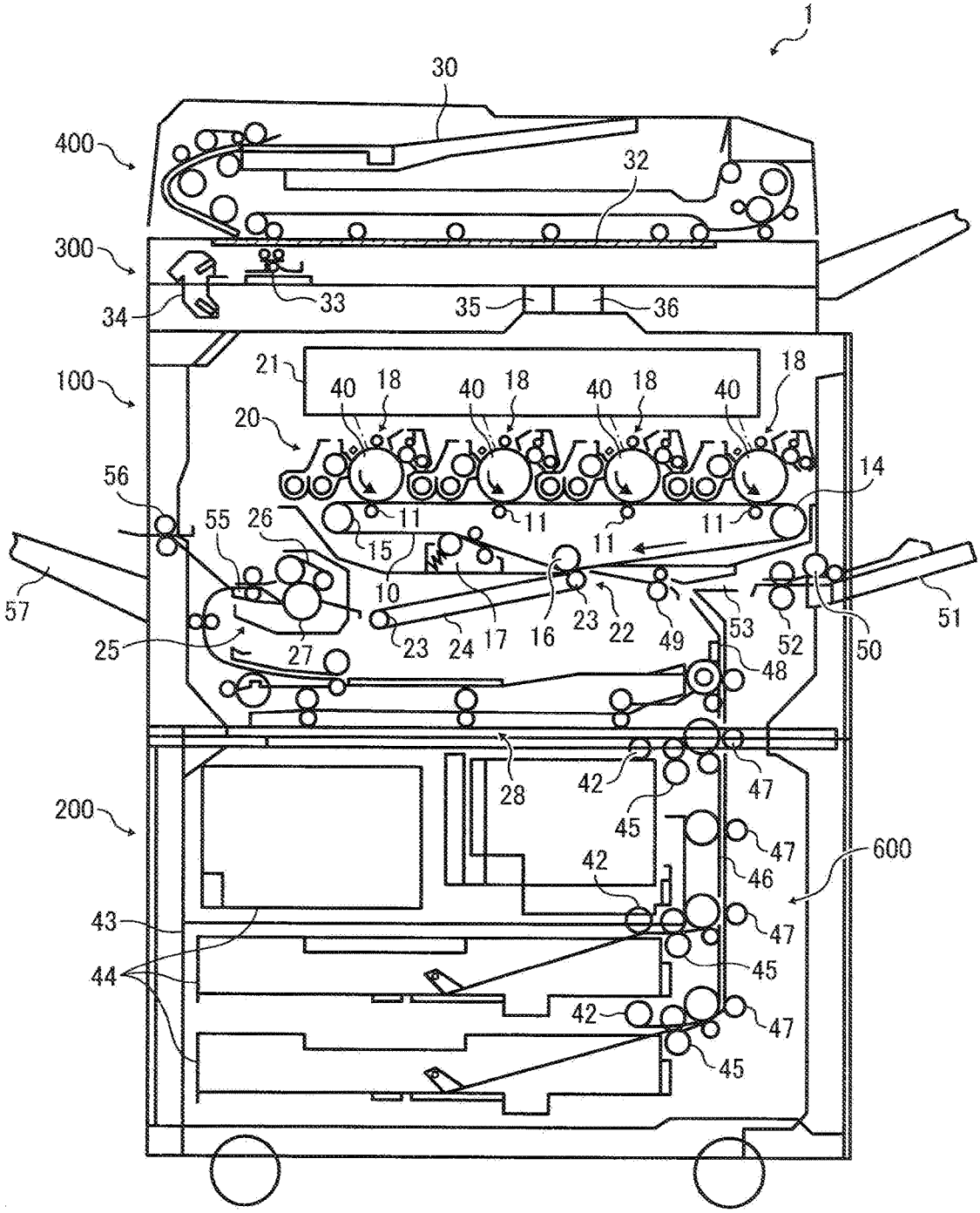
FIG. 1 is a diagram illustrating a schematic configuration of an image forming apparatus according to an embodiment of the present invention.

It will be understood that if an element or layer is referred to as being "on", "against", "connected to" or "coupled to"

another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present invention.

The terminology used herein is for describing particular embodiments and is not intended to be limiting of exemplary embodiments of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of the present invention. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of the present invention.

The present invention is applicable to any image forming apparatus, and is implemented in the most effective manner in an electrophotographic image forming apparatus.

In describing preferred embodiments illustrated in the drawings, specific terminology is employed for the sake of clarity. However, the disclosure of the present invention is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of the present invention are described.

A description is given of an electrophotographic image forming apparatus 1 according to an embodiment of the present invention, with reference to FIG. 1.

FIG. 1 is a diagram illustrating a schematic configuration of the image forming apparatus 1 according to an embodiment of the present invention.

The image forming apparatus 1 may be a copier, a facsimile machine, a printer, a plotter, a multifunction peripheral or a multifunction printer (MFP) having at least one of copying, printing, scanning, facsimile, and plotter functions, or the like. According to the present embodiment, the image forming apparatus 1 is a color electrophotographic image forming apparatus that forms color and monochrome toner images on a sheet or sheets by electrophotography.

Further, it is to be noted in the following embodiments that the term "sheet" is not limited to indicate a paper material but also includes OHP (overhead projector) transparencies, OHP film sheets, coated sheet, thick paper such as post card, thread, fiber, fabric, leather, metal, plastic, glass, wood, and/or ceramic by attracting developer or ink thereto, and is used as a general term of a recorded medium, recording medium, recording sheet, and recording material to which the developer or ink is attracted.

As illustrated in FIG. 1, the image forming apparatus 1 includes an apparatus body 100 that includes a toner image forming part 20 that functions as an image forming device having four image forming units for forming respective toner images having different color toners, which are yellow (Y), cyan (C), magenta (M), and black (K). Each image forming unit included in the toner image forming part 20 has photoconductor units 40, each of which functions as a latent image carrier, a charger unit 18 that functions as a charger, a developing unit, a cleaning unit, and so forth. Each image forming unit is provided with an IC (integrated circuit) tag and is detachably attached to the apparatus body 100.

An optical writing unit 21 is disposed above the toner image forming part 20. The optical writing unit 21 irradiates respective laser light beams according to image data onto each surface of the drum-shaped photoconductors (i.e., the photoconductor unit 40) of the toner image forming part 20 to form electrostatic images on the respective surfaces of the photoconductor units 40.

An intermediate transfer unit is disposed below the toner image forming part 20. The intermediate transfer unit includes an intermediate transfer belt 10 that functions as a loop-shaped endless belt. The intermediate transfer belt 10 has a base layer including, for example, a less stretchable fluorine resin or a stretchable rubber material and a canvas that is non-stretchable, and multiple layered belt having an elastic layer can be used. The elastic layer includes a coat layer having high smoothness manufactured by, for example, coating a fluorine-based resin on a surface of a fluorine-containing rubber or a surface of an acrylonitrile-butadiene copolymer containing rubber.

The intermediate transfer belt 10 is wound around three support rollers, which are a first support roller 14, a second support roller 15, and a third support roller 16. The intermediate transfer belt 10 rotates clockwise in FIG. 1.

An intermediate transfer member cleaning unit 17 is disposed in the vicinity of the second support roller 15 in FIG. 1.

Primary transfer rollers 11 are disposed facing the respective photoconductor units 40 with the intermediate transfer belt 10 interposed therebetween. The primary transfer rollers 11 perform a primary transfer process to transfer respective toner images onto a surface of the intermediate transfer belt 10.

A secondary transfer unit 22 is disposed below the intermediate transfer belt 10. The secondary transfer unit 22 includes a secondary transfer belt 24 that functions as an endless belt, and two rollers 23 around which the secondary transfer belt 24 is wound. The secondary transfer belt 24 is pressed against the third support roller 16 that functions as a secondary transfer roller that supports the intermediate transfer belt 10. The secondary transfer belt 24 performs a secondary transfer process to transfer a composite toner image that is primarily transferred onto the surface of the intermediate transfer belt 10 onto a sheet that serves as a recording medium.

A fixing unit 25 is disposed on the left side of the secondary transfer unit 22 in FIG. 1. The fixing unit 25 fixes the toner image secondarily transferred onto the sheet to the sheet. The fixing unit 25 includes a fixing belt 26 that functions as an endless belt, and a pressure roller 27 against which the fixing belt 26 is pressed.

A sheet reverse unit 28 is disposed below the secondary transfer unit 22 and the fixing unit 25. The sheet reverse unit 28 reverses the sheet to form a toner image on a back side of the sheet having a previously transferred toner image formed on a front side thereof.

As a start button provided on an operation unit of the image forming apparatus 1 is pressed, when there is an original document placed on a document table 30 of an automatic document feeder (ADF) 400, the original document is conveyed onto an exposure glass 32. By contrast, when there is no document placed on the document table 30 of the ADF 400, image data of the original document manually placed on the exposure glass 32 is read. To read the image data, a scanner included in an image reading unit 300 is driven to move a first carriage 33 and a second carriage 34. While the laser light beam is emitted from a light source on the first carriage 33 to the exposure glass 32, a reflected light from a surface of the original document is reflected by a first mirror on the first carriage 33 toward the second carriage 34. Then, the reflected light from a mirror on the second carriage 34 goes through an image forming lens 35 to form an image thereon, and then the image is taken to an image sensor 36 including CCDs (charge coupled devices). Based on image signals obtained by the image sensor 36, recording data of different single colors, which are yellow (Y), cyan (C), magenta (M), and black (K), are generated.

Further, as a start button that is provided on an operation unit of the image forming apparatus 1 is pressed, the intermediate transfer belt 10 starts to rotate. At the same time, the image forming apparatus 1 starts preparing image formation to be performed in each image forming unit of the toner image forming part 20. Then, an image forming sequence of each color toner is executed. The optical writing unit 21 emits laser light modulated based on image forming data to respective drum-shaped photoconductor units 40 to form respective single color images on the surfaces of the photoconductor units 40. Then, the respective single color images are transferred onto the surface of the intermediate transfer belt 10 at respective positions where the primary transfer rollers 11 and the corresponding photoconductor units 40 face each other with the intermediate transfer belt 10 interposed therebetween. By following the image forming sequence, respective toner images of different single colors are sequentially laid onto the surface of the intermediate transfer belt 10 with the action of the primary transfer rollers 11 to form a composite toner image on the intermediate transfer belt 10.

Thus, the sheet is conveyed to a secondary transfer region in synchronization with a timing that the leading edge of the toner image formed on the intermediate transfer belt 10 enters the secondary transfer region facing the secondary transfer unit 22. According to this action, the toner image formed on the intermediate transfer belt 10 is transferred onto the sheet.

The sheet having the toner image transferred from the intermediate transfer belt 10 is conveyed to the fixing unit 25, where the toner image is fixed to the sheet.

The sheet processed in the fixing unit 25 and discharged therefrom is guided to a sheet discharging roller pair 56 by a switching claw 55. The switching claw 55 moves to guide the sheet either to a sheet discharging tray 57 in which the sheet is stacked therein or to the sheet reverse unit 28. The sheet reverse unit 28 reverses the sheet, so that the sheet is conveyed to the secondary transfer region again to form an image on the back side thereof. Thereafter, the sheet is guided to the sheet discharging roller pair 56 to be discharged to the sheet discharging tray 57.

Residual toner remaining on the surface of the intermediate transfer belt 10 after the secondary transfer process is removed by the intermediate transfer member cleaning unit 17 to prepare for a subsequent image forming operation.

It is to be noted that the sheet is fed from a sheet feed table 200. The sheet feed table 200 includes multiple sheet feed rollers 42, multiple sheet feed trays 44 vertically provided in a sheet feed unit 43, multiple sheet separation rollers 45, a conveying roller unit 46, and sheet conveying roller pairs 47. Specifically, as a selected one of the sheet feed rollers 42 of the sheet feed table 200 rotates, the sheet is fed from a corresponding one of the sheet feed trays 44. After a corresponding one of the sheet separation rollers 45 separates the sheet one by one, the sheet is conveyed to the conveying roller unit 46 that defines a sheet conveying path. Then, a corresponding one of the sheet conveying roller pairs 47 guides the sheet to a conveying roller unit 48 provided in the image forming apparatus 1. The sheet stops on abutment against a registration roller pair 49 of the conveying roller unit 48. Thereafter, in synchronization of movement of the toner image transferred onto the surface of the intermediate transfer belt 10, conveyance of the sheet is started again to convey the sheet to the secondary transfer region.

Alternatively, the sheet can be fed from a bypass tray 51. As a user places the sheet on the bypass tray 51, a sheet feed roller 50 rotates to feed the sheet from the bypass tray 51. After the sheet is separated from the other sheet(s) placed on the bypass tray 51 by a sheet separation roller 52, the sheet is conveyed into a bypass sheet feed path 53. Then, when the sheet abuts against the registration roller pair 49, the sheet stops and stays there until the registration roller pair 49 starts to convey the sheet further.

The sheet feed table 200 further includes various sensors including, for example, photosensors. Specifically, the various sensors include at least one of a paper end sensor, a size detection sensor, and a tray set detection sensor. The paper end sensor detects an amount of remaining sheets accommodated in a corresponding one of the sheet feed trays 44 and whether or not there are any sheets left in the sheet feed tray 44. The size detection sensor detects detect sheet size and direction. The tray set detection sensor detects whether or not each sheet tray of the image forming apparatus 1 is attached to the apparatus body 100. In addition, a sheet conveyance sensor is attached to each sheet feed tray to detect whether or not the sheet is conveyed appropriately during sheet conveyance and/or whether or not a sheet conveying jam (i.e., a paper jam) is occurring.

The registration roller pair 49 is generally grounded electrically. However, a bias voltage can be applied to the registration roller pair 49 to remove paper dust from the sheet. Specifically, for example, when the bias voltage is applied with a conductive rubber roller, the conductive rubber roller is manufactured to include a conductive NBR (nitrile butadiene rubber) rubber having a diameter of approximately 18 mm and a surface thickness of approximately 1 mm. The volume resistivity of the conductive NBR rubber is approximately $10^9$ Ωcm in electrical resistance. The printed surface of the sheet that has passed the registration roller pair 49 applied with the bias voltage is charged to a minus polarity. Accordingly, compared with transfer conditions in printing the sheet that is passed through the biased registration roller pair 49, the following secondary transfer process has different transfer conditions in printing the sheet that has passed through the biased registration roller pair 49. In the present embodiment, the bias voltage is applied to the registration roller pair 49. In addition, as the transfer conditions, for example, the third support roller 16 functioning as a secondary transfer roller that supports the intermediate transfer belt 10 is applied with a bias voltage of approximately −800V and one of the two rollers 23 (i.e., a secondary transfer opposed roller 23) that are wound around the secondary transfer belt 24 of the secondary transfer unit 22 is applied with a bias voltage of approximately +200V.

Comparative Example

Figure 2:
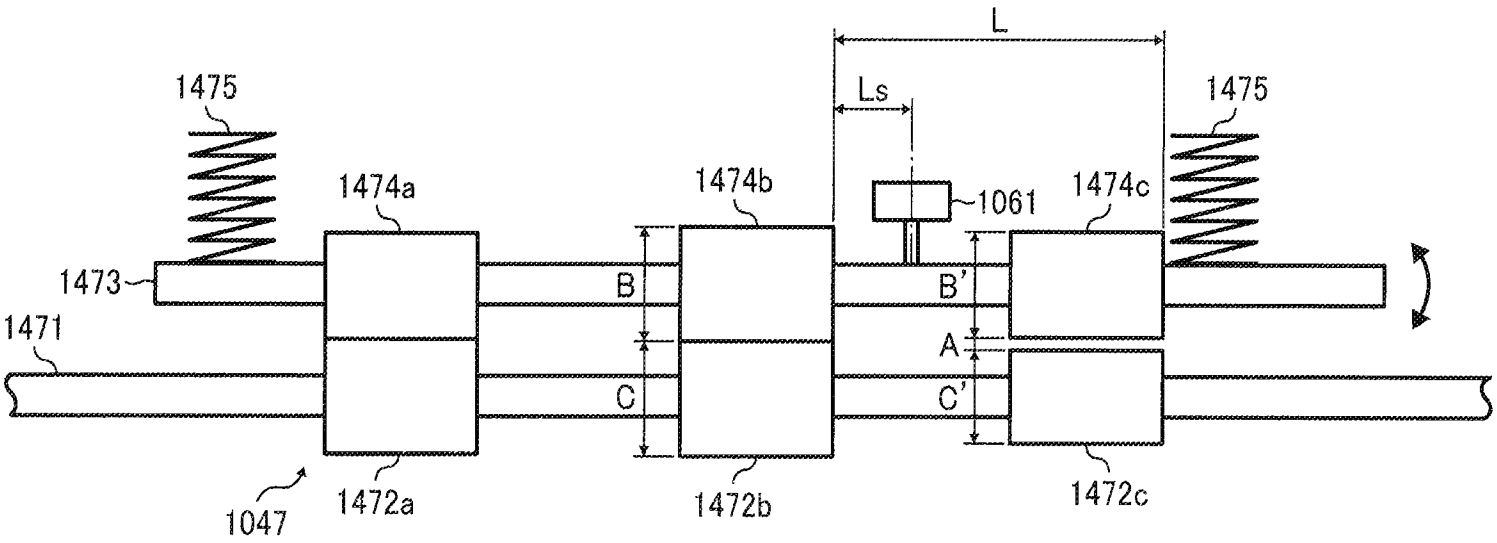
FIG. 2 is a diagram illustrating a schematic configuration of a sheet thickness detector according to a comparative example.

FIG. 2 is a diagram illustrating a schematic configuration of a sheet thickness detector according to a comparative example.

The comparative sheet thickness detector corresponds to a sheet conveying roller pair 1047 illustrated in FIG. 2. The sheet conveying roller pair 1047 includes three drive rollers 1472*a*, 1472*b*, and 1472*c*, three driven rollers 1474*a*, 1474*b*, and 1474*c*, and two compression springs 1475.

The drive rollers 1472*a*, 1472*b*, and 1472*c* are fixed to a drive roller shaft 1471. The driven rollers 1474*a*, 1474*b*, and 1474*c* are rotatably (as indicated by arrow in FIG. 2) attached to a driven roller shaft 1473. Each of the compression springs 1475 functions as a biasing member. The compression springs 1475 are provided at both sides in an axial direction of the driven roller shaft 1473. The driven roller shaft 1473 is biased by the compression springs 1475 toward the drive roller shaft 1471. Due to a biasing force applied by the compression springs 1475, the driven rollers 1474*a*, 1474*b*, and 1474*c* are biased toward the drive rollers 1472*a*, 1472*b*, and 1472*c*, respectively.

A displacement sensor 1061 detects an amount of displacement of the driven roller shaft 1473. The displacement sensor 1061 is disposed such that the leading edge of the displacement sensor 1061 contacts the driven roller shaft 1473 from the opposite side to the drive roller shaft 1471.

When a sheet enters between the drive rollers 1472*a*, 1472*b*, and 1472*c* and the driven rollers 1474*a*, 1474*b*, and 1474*c*, respectively, the driven rollers 1474*a*, 1474*b*, and 1474*c* are pushed up due to a thickness of the sheet or a sheet thickness. Accordingly, the driven roller shaft 1473 is displaced to a direction to separate from the drive roller shaft 1471. The displacement sensor 1061 detects the amount of displacement of the driven roller shaft 1473. According to the detection result obtained by the displacement sensor 1061, a controller provided in an image forming apparatus determines the sheet thickness.

As illustrated in FIG. 2, reference mark A represents a gap that is formed between the drive roller 1472*c* and the driven roller 1474*c*. Reference marks B and B' represent a diameter of the driven roller 1474*b* and a diameter of the drive roller 1472*b*, respectively. Reference marks C and C' represent a diameter of the driven roller 1474*c* and a diameter of the drive roller 1472*c*, respectively.

Because the driven rollers 1474*a*, 1474*b*, and 1474*c* and the drive rollers 1472*a*, 1472*b*, and 1472*c* are occasionally manufactured with nonuniformity in diameter thereof, the sheet conveying roller pair 1047 has variation of diameters of the driven rollers 1474*a*, 1474*b*, and 1474*c*, which is referred to as a variation (B−B')/2 and variation of diameters of the drive rollers 1472*a*, 1472*b*, and 1472*c*, which is referred to as a variation (C−C')/2, as illustrated in FIG. 2. Due to the variation of diameters, the driven roller 1474*c* and the drive roller 1472*c* do not contact, so that the gap A having a length of (B−B')/2+(C−C')/2 may be generated. The gap A can produce an amount of displacement of the driven roller shaft 1473 by at least an amount Ls/L of the gap A at a portion where the displacement sensor 1061 contacts the driven roller shaft 1473. As illustrated in FIG. 2, a length L represents a distance between right side surfaces of the drive rollers 1474*c* and 1474*b* and a length Ls represents a distance between a vertical center of the displacement sensor 1061 and the right side surface of the drive roller 1474*b*. This displacement occurs due to the following reasons.

As illustrated in FIG. 2, in a state in which the sheet does not exist in the sheet conveying roller pair 1047, the posture of the driven roller shaft 1473 that is biased by the compression springs 1475 is stable in contact with the drive rollers 1472*a* and 1472*b* at two points, which are the driven roller 1474*a* and the driven roller 1474*b*. When the sheet enters the sheet conveying roller pair 1047, the posture of the driven roller shaft 1473 may or may not tilt according to a balance of the biasing force of the compression springs 1475 biasing both ends of the driven roller shaft 1473.

Specifically, depending on the balance of the biasing force, the driven roller shaft 1473 may remain stable, for example, in a state in which the sheet is held by the driven roller 1474*b* and the driven roller 1474*c* and is not held by the driven roller 1474*a*. In this case, the driven roller shaft 1473 tilts according to the size of the gap A. At this time, while the amount of displacement of the driven roller 1474*b* corresponds to the sheet thickness, the amount of displacement of the driven roller 1474*c* corresponds to a value that is obtained by subtracting the sheet thickness from the gap A. Therefore, the amount of displacement at a position where the displacement sensor 1061 contacts a portion shifting to the third driven roller 1474*c* by the length Ls from the driven roller 1474*b* does not correspond to the sheet thickness. That is, the amount of displacement at the contact portion of the displacement sensor 1061 includes an error of the gap A that corresponds to the amount Ls/L with respect to the sheet thickness.

By contrast, depending on the balance of the biasing force, the driven roller shaft 1473 may remain stable, for example, in a state in which the sheet is held by the driven roller 1474*a* and the driven roller 1474*b* and is not held by the driven roller 1474*c*. In this case, the driven roller shaft 1473 does not tilt since the gap A does not affect the posture of the driven roller shaft 1473. At this time, the amount of displacement of the driven roller 1474*a* and the amount of displacement of the driven roller 1474*b* correspond to the sheet thickness. Therefore, the amount of displacement at the contact portion of the displacement sensor 1061 does not include the error of the gap A corresponding to the amount Ls/L with respect to the sheet thickness.

As described above, in a case in which there is the gap A between the driven roller 1474*c* and the drive roller 1472*c*, even when the sheets having the same thickness are conveyed, the amount of displacement at the contact portion of the displacement sensor 1061 has the above-described error nor not. Therefore, the amount of displacement at the contact portion of the displacement sensor 1061 is generated by the at least amount Ls/L of the gap A. Accordingly, the sheet thickness has not been detected accurately.

Here, by reducing the displacement of diameter of the drive rollers 1472*a*, 1472*b*, and 1472*c* and the displacement of diameter of the driven rollers 1474*a*, 1474*b*, and 1474*c*, the gap A can be decreased, so that the accuracy in detection of the sheet thickness can be enhanced. However, in this case, an allowable tolerance of diameter of each roller (i.e., the drive rollers 1472*a*, 1472*b*, and 1472*c* and the driven rollers 1474*a*, 1474*b*, and 1474*c*) is reduced, which results in an unavoidable increase in cost. For example, to determine a difference of the sheet thicknesses in a range of some 10 μm, the allowable tolerance of diameter of each roller falls within some 10 μm. Meeting this requirement contributes to a relatively increase in cost.

Embodiment 1

Figure 3:
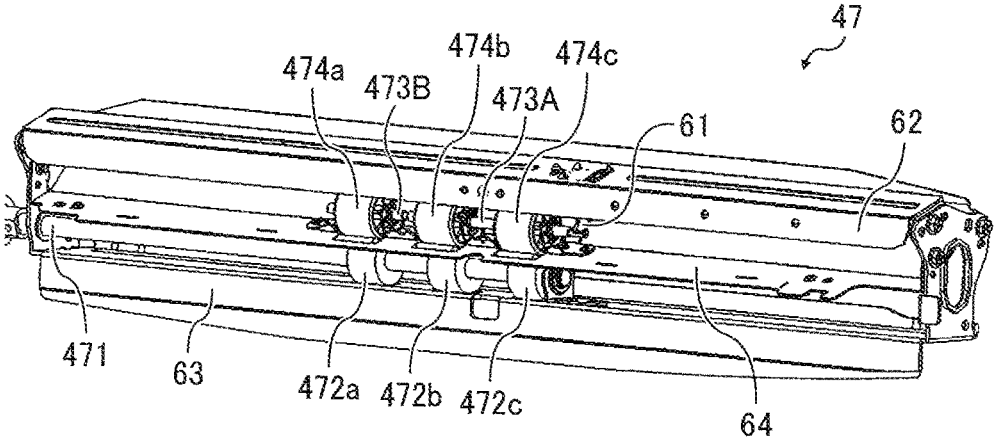
FIG. 3 is a diagram illustrating a configuration of a conveying roller pair functioning as a sheet thickness detector included in the image forming apparatus of FIG. 1, according to Embodiment 1.
Figure 4:
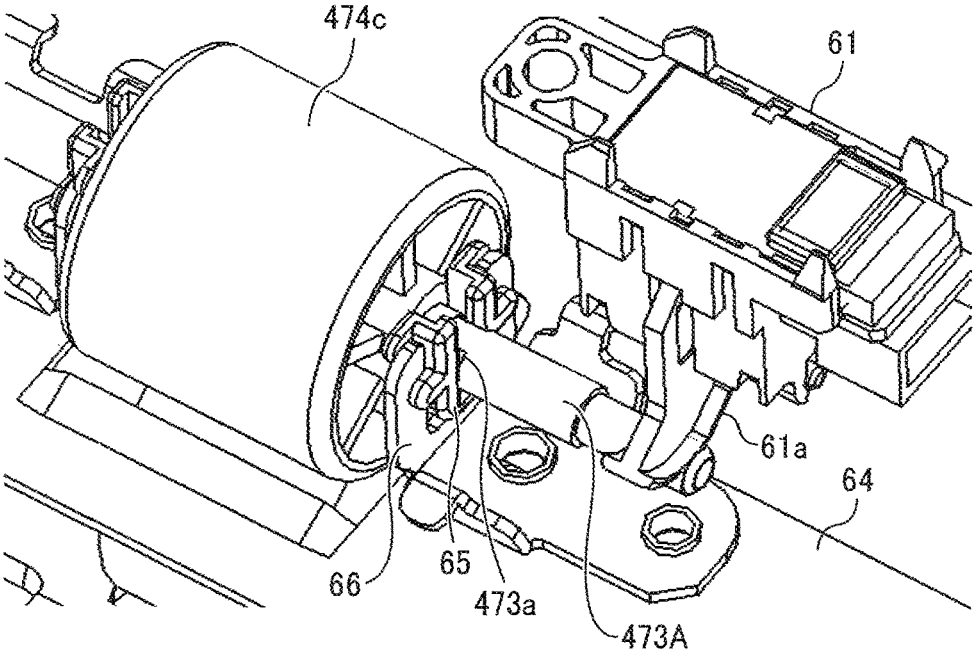
FIG. 4 is an enlarged perspective view illustrating a sheet thickness detecting part of the conveying roller pair of FIG. 3.

FIG. 3 is a perspective view illustrating an example of a configuration of one of the sheet conveying roller pairs 47 functioning as a sheet thickness detector of the image forming apparatus 1 of FIG. 1 according to Embodiment 1. FIG. 4 is an enlarged perspective view illustrating a sheet thickness detection part of the sheet conveying roller pair 47 of FIG. 3.

As described above, the image forming apparatus 1 includes the multiple sheet conveying roller pairs 47. For simplicity, the sheet conveying roller pairs 47 are hereinafter referred to in a singular form. It is to be noted that, even though it is written in a singular form, the structure and functions of the sheet conveying roller pairs 47 are basically identical to each other, except at least one sheet conveying roller pair 47 that functions as a sheet thickness detector.

In Embodiment 1, the sheet thickness is detected when the sheet passes the sheet conveying roller pair 47 that functions as a sheet thickness detector and that is disposed in the sheet conveying path (defined by the conveying roller unit 46) upstream from the registration roller pair 49 in a sheet conveying direction.

The sheet conveying roller pair 47 according to Embodiment 1 includes a drive roller shaft 471, drive rollers 472*a*, 472*b*, and 472*c*, driven roller shafts 473A and 473B, and driven rollers 474*a*, 474*b*, and 474*c*. The driven roller shaft 473A is also referred to as a first driven roller shaft 473A that functions as a first roller shaft and the driven roller shaft 473B is also referred to as a second driven roller shaft 473B that functions as a second roller shaft. The driven rollers 474*a*, 474*b*, and 474*c* functioning as first rollers are rotatably attached to the driven roller shafts 473A and 473B. The drive roller shaft 471 functions as a third roller shaft. The drive rollers 472*a*, 472*b*, and 472*c* functioning as second rollers are fixedly mounted on the drive roller shaft 471 in an axial direction. The drive rollers 472*a*, 472*b*, and 472*c* are disposed facing the driven rollers 474*a*, 474*b*, and 474*c*, respectively, to form roller pairs.

It is to be noted that, even though the sheet conveying roller pair 47 as the sheet thickness detector includes three driven rollers, three drive rollers, and three roller pairs, the numbers of drive rollers, driven rollers, and roller pairs are not limited thereto. Any sets of drive rollers, driven rollers, and roller pairs can be applied to the sheet thickness detector.

Both edges of the drive roller shaft 471 in the axial direction thereof are rotatably supported by respective bearings mounted on a stay 63. The drive roller shaft 471 is supported so as not to move in a radial direction of the drive rollers 472*a*, 472*b*, and 472*c*. The drive roller shaft 471 receives a rotation driving force from a driving source, and thereby rotating around an axis thereof. Due to this rotation, the drive rollers 472*a*, 472*b*, and 472*c* rotate to apply a conveying force to the sheet that passes the sheet conveying roller pair 47.

In the present embodiment, the driven roller shafts 473A and 473B are mounted coaxially. The driven roller shaft 473A functioning as a first roller shaft has two driven rollers, which are the driven rollers 474*b* and 474*c* thereon. The second driven roller shaft 473B functioning as a second roller shaft has one driven roller, which is the driven roller 474*a*. As illustrated in FIG. 4, the first driven roller shaft 473A is supported by a roller shaft holder 66 that functions as a first roller shaft holder that is mounted on a stay 64. The roller shaft holder 66 supports the first driven roller shaft 473A movably and unrotatably in a sheet thickness direction.

Specifically, as illustrated in FIG. 4, a guide rib 65 is provided on the roller shaft holder 66 mounted on the stay 64, and two guide grooves 473*a* are provided on the first driven roller shaft 473A so that the guide rib 65 fits into the guide grooves 473*a*. The two guide grooves 473*a* have respective notches (cutout portions) arranged to extend in parallel in a direction perpendicular to the axial direction of the first driven roller shaft 473A. The first driven roller shaft 473A is supported by the roller shaft holder 66 in a manner in which the guide rib 65 is fitted into the guide grooves 473*a*. As a result, axial rotation of the first driven roller shaft 473A is regulated by the guide rib 65 while the first driven roller shaft 473A is movable along the guide rib 65 in the sheet thickness direction. It is to be noted that a basic structure and functions of the second driven roller shaft 473B are same as those of the first driven roller shaft 473A.

Both the driven roller shafts 473A and 473B are biased by respective biasing members such as springs in a direction toward the drive roller shaft 471. As described above, the driven rollers 474*a*, 474*b*, and 474*c* are rotatably attached to the driven roller shafts 473A and 473B to rotate along with rotation of the drive rollers 472*a*, 472*b*, and 472*c* disposed opposite to the driven rollers 474*a*, 474*b*, and 474*c*, respectively, in a direction to be rotated with the driven rollers 474*a*, 474*b*, and 474*c*.

In this embodiment, a displacement sensor 61 that functions as a displacement amount detector is provided to detect an amount of displacement of the first driven roller shaft 473A in a contact/separation direction (i.e., the sheet thickness direction) to the drive roller shaft 471. The displacement sensor 61 includes a lever-type encoder sensor that functions a contact-type displacement sensor having a detection arm 61*a* and a detecting part 61*b*. The detection arm 61*a* functions as a moving body that moves along with displacement of the first driven roller shaft 473A. The detecting part 61*b* detects an amount of movement of the detection arm 61*a*. However, the type of a sensor applicable to the present invention is not limited to the above-described encoder sensor. For example, as a non-contact type displacement sensor such as an optical ranging sensor or any sensor that detects the amount of displacement of the first driven roller shaft 473A without contacting the first driven roller shaft 473A can be applied to the present invention.

The displacement sensor 61 is disposed such that the detection arm 61*a* contacts the first driven roller shaft 473A from the opposite side of the drive roller shaft 471 with respect to the first driven roller shaft 473A. The displacement sensor 61 is fixed to a stay 62 (refer to FIG. 3) so as not to be affected by displacement of the first driven roller shaft 473A.

As the sheet enters the sheet conveying roller pair 47 according to Embodiment 1, the driven rollers 474*a*, 474*b*, and 474*c* are pushed up due to the sheet thickness, thereby moving or displacing the driven rollers 474*a*, 474*b*, and 474*c* in a direction to separate from the drive rollers 472*a*, 472*b*, and 472*c*. According to this movement, the detection arm 61*a* of the displacement sensor 61 moves by the amount of displacement of the first driven roller shaft 473A. Consequently, the amount of movement of the detection arm 61*a* is detected by the displacement sensor 61. As a result, the detection result obtained by the displacement sensor 61 is sent to a controller 500 (refer to FIG. 5) which is disposed in the apparatus body 100 to control a series of sheet conveying operations performed by the image forming apparatus 1. Based on the detection result, the controller 500 grabs and determines the sheet thickness.

According to the sheet thickness obtained as described above, the controller 500 adjusts the series of sheet conveying operations by changing a speed of sheet conveyance and a nip pressure of a conveying roller pair, the image forming operations such as secondary transfer conditions (a bias value in secondary transfer), and a fixing temperature.

It is to be noted that, in Embodiment 1, the second driven roller shaft 473B that supports the driven roller 474*a* that is not used for detection of the sheet thickness can be shifted in the direction of the sheet thickness. However, an alternative simple configuration in which the second driven roller shaft 473B is disposed unmovable in the sheet thickness direction may also be applied.

According to the present embodiment, there are two driven rollers attached to the first driven roller shaft 473A by using which the displacement sensor 61 detects the amount of displacement. Therefore, even if the driven rollers 474*b* and 474*c* have non-uniform diameters, the first driven roller shaft 473A tilts or inclines according to the variation in diameter. Consequently, the driven rollers 474*b* and 474*c* contact the opposed driven rollers 472*b* and 472*c*, respectively.

In the comparative configuration in which three driven rollers (i.e., the driven rollers 1474*a*, 1474*b*, and 1474*c*) are mounted on a first driven roller shaft (i.e., the first driven roller shaft 1473), a gap (i.e., the gap A) is formed between any driven roller and a corresponding drive roller due to variation of roller diameters of the driven rollers.

By contrast, the configuration according to Embodiment 1 does not form any gap, thereby removing a decrease in accuracy of the sheet thickness detection, which has been induced by the gap. As a result, a highly accurate sheet thickness detection can be achieved.

Figure 5:
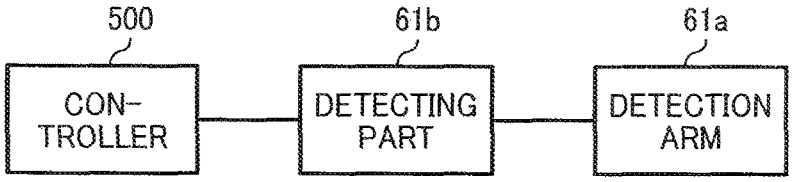
FIG. 5 is a block diagram illustrating a schematic configuration of a controller provided in the image forming apparatus of FIG. 1.

FIG. 5 is a block diagram illustrating the controller 500 and connected components. In FIG. 5, the detecting part 61*b* is connected to the controller 500 and is also connected to the detection arm 61*a*.

It is to be noted that the sheet separation roller 45, the drive rollers 472*a* through 472*j*, the registration roller pair 49 and so forth form a conveying force applier that applies the conveying force to the sheet. It is also to be noted that multiple sheet feed trays 44, the multiple sheet separation rollers 45, the conveying roller unit 46, the multiple sheet conveying roller pair 47, the conveying roller unit 48, the first support roller 14, the primary transfer rollers 11, the secondary transfer unit 22, the rollers 23, the secondary transfer belt 24, the pressure roller 27, the sheet discharging tray 57 and so forth form a sheet conveyor 600.

Embodiment 2

Figure 6:
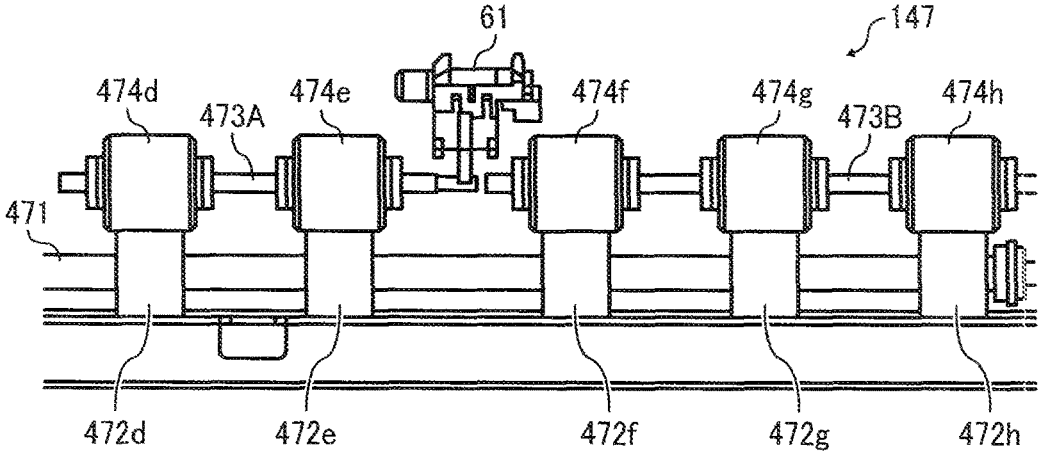
FIG. 6 is a perspective view illustrating another configuration of the conveying roller pair according to Embodiment 2.

Next, a description is given of another configuration according to the sheet conveying roller pair 47, which is a sheet conveying roller pair 147 according to Embodiment 2, with reference to FIG. 6.

FIG. 6 is a perspective view illustrating the configuration of the conveying roller pair 147.

Elements or components of the sheet conveying roller pair 147 are similar in structure and functions to the elements or components of the sheet conveying roller pair 47, except some features described below.

Compared to the sheet conveying roller pair 47 according to Embodiment 1 including three roller pairs, the sheet conveying roller pair 147 of Embodiment 2 includes five roller pairs.

In this example, the conveying roller pair 147 includes the drive roller shaft 471, five drive rollers 472*d*, 472*e*, 472*f*, 472*g*, and 472*h*, the driven roller shafts 473A and 473B, and five driven rollers 474*d*, 474*e*, 474*f*, 474*g*, and 474*h*. The driven rollers 474*d*, 474*e*, 474*f*, 474*g*, and 474*h* are mounted on the driven roller shafts 473A and 473B. Specifically, the driven rollers 474*d* and 474*e* are mounted on the first driven roller shaft 473A that functions as a first roller shaft, and the driven rollers 474*f*, 474*g*, and 474*h* are mounted on the second driven roller shaft 473B that functions as a second roller shaft.

In this example, two driven rollers are mounted on the first driven roller shaft 473A so that the displacement sensor 61 detects the amount of displacement of the first driven roller shaft 473A. Therefore, even if the driven rollers 474*d* and 474*e* are not uniform in diameter, the first driven roller shaft 473A tilts or inclines according to the difference or variation. Accordingly, the driven rollers 474*d* and 474*e* contact the drive rollers 472*d* and 472*e*, respectively, disposed facing the driven rollers 474*d* and 474*e*. With this configuration, no gap is created between the drive rollers 474*d* and 474*e* and the drive rollers 472*d* and 472*e*, respectively. As a result, a decrease in accuracy of the sheet thickness detection caused by the gap is no longer generated, thereby achieving the highly accurate sheet thickness detection.

Figure 7:
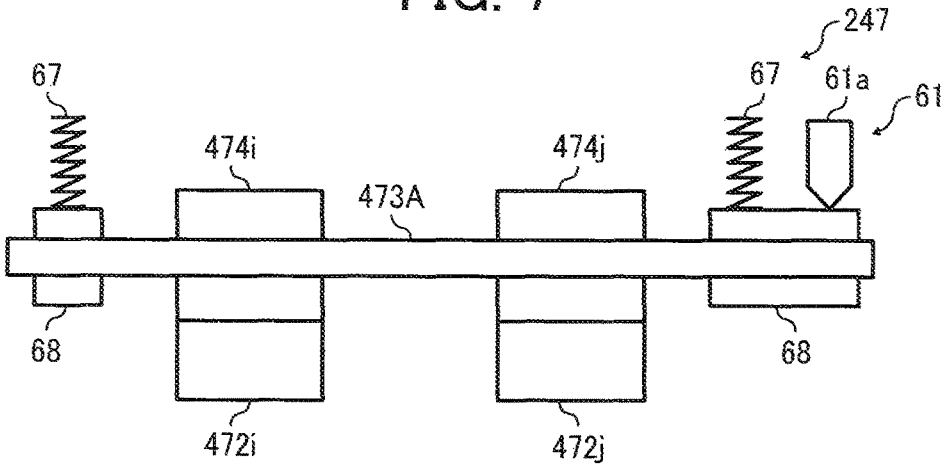
FIG. 7 is a diagram illustrating yet another configuration of the conveying roller pair according to Embodiment 3.

Next, a description is given of yet another configuration of the sheet conveying roller pair 47, which is a sheet conveying roller pair 247 according to Embodiment 3, with reference to FIG. 7.

FIG. 7 is a diagram illustrating the configuration of the sheet conveying roller pair 247.

Elements or components of the sheet conveying roller pair 247 are similar in structure and functions to the elements or components of the sheet conveying roller pair 47, except some features described below.

The sheet conveying roller pair 47 according to Embodiment 1 includes three roller pairs, the sheet conveying roller pair 247 of Embodiment 3 includes two roller pairs. Further, in the sheet conveying roller pair 47 according to Embodiment 1, the first driven roller shaft 473A is fixed so as not to rotate while the driven rollers 474*b* and 474*c* are rotatably attached to the first driven roller shaft 473A. By contrast, in the sheet conveying roller pair 247 of Embodiment 3, the first driven roller shaft 473A is rotatably supported while the driven rollers 474*b* and 474*c* are fixed to the first driven roller shaft 473A so as not to rotate about the first driven roller shaft 473A.

The following description is given of the configuration of the sheet conveying roller pair 247 different from the configuration of the sheet conveying roller pair 47.

In this example, the conveying roller pair 247 includes the driven roller shaft 473A, two driven rollers 474*i* and 474*j*, a drive roller shaft, and two drive rollers 472*i* and 472*j*. The driven rollers 474*i* and 474*j* are fixedly mounted on the first driven roller shaft 473A. Both lateral ends of the first driven roller shaft 473A are rotatably supported by bearings 68. The bearings 68 are supported by a bearing holder of the stay 64 so as to be movable in the sheet thickness direction. In this example, the bearings 68 are biased by respective compression springs 67 toward the drive roller shaft 471. Each of the compression springs 67 functions as a biasing member. The detection arm 61*a* of the displacement sensor 61 contacts one of the bearings 68, so that the detection arm 61*a* can detect an amount of displacement of the corresponding bearing 68.

In Embodiment 3, two rollers (i.e., the driven rollers 474*i* and 474*j*) are mounted on the first driven roller shaft 473A, and the amount of displacement of the first driven roller shaft 473A is detected by the displacement sensor 61. Therefore, even if the driven rollers 474*i* and 474*j* are not uniform in diameter, the first driven roller shaft 473A tilts or inclines according to the variation thereof. Accordingly, the driven rollers 474*i* and 474*j* contact the corresponding drive rollers 472*i* and 472*j* disposed facing the driven rollers 474*i* and 474*j*. With this configuration, no gap is created between the drive rollers 474*i* and 474*j* and the respective drive rollers 472*i* and 472*j*, respectively. As a result, a decrease in accuracy of the sheet thickness detection caused by the gap is no longer generated, thereby achieving the highly accurate sheet thickness detection.

The configurations according to the above-described embodiments (for example, Embodiments 1, 2, and 3) are examples. The present invention can achieve the following aspects effectively.

Aspect A.

In Aspect A, a sheet thickness detector (for example, the sheet conveying roller pairs 47, 147, and 247) for detecting a thickness of a sheet to be conveyed has a configuration including multiple first rollers (for example, the driven rollers 474*a* through 474*j*) aligned in a direction perpendicular to the sheet conveying direction, multiple second rollers (for example, the drive rollers 472*a* through 472*j*) disposed facing the respective multiple first rollers, a first roller shaft (for example, the first driven roller shaft 473A) that supports two first rollers (for example, the driven rollers 474*b* and 474*c*, and the driven rollers 474*d* and 474*e*) of the multiple first rollers, at least one second roller shaft (for example, the second driven roller shaft 473B) that supports the multiple first rollers (for example, the driven rollers 474*a*, 474*f*, 474*g*, and 474*h*) other than the two first rollers, at least one third roller shaft (for example, the drive roller shaft 471) that supports at least three second rollers of the multiple second rollers, a first roller shaft holder (for example, the roller shaft holder 66) that supports the first roller shaft to move from the third roller shaft in a contact/separation direction (the sheet thickness direction), a biasing member (for example, the compression springs 67) that biases the first roller shaft toward the at least one third roller shaft in the contact/separation direction, and a displacement amount detector (for example, the displacement sensor 61) that detects an amount of displacement of the first roller shaft in the contact/separation direction. Based on a detection result obtained by the displacement amount detector, the sheet thickness detector detects the thickness of a sheet held between the multiple first rollers and the multiple second rollers.

Accordingly, two first rollers are mounted on the first roller shaft, an amount of displacement of which is detected by the displacement amount detector. Therefore, even if the two first rollers are not uniform in diameter, the first roller shaft tilts according to the displacement (variation) and the two first rollers contact the corresponding second rollers in a stable manner. While the comparative configuration having three or more first rollers are mounted on the first roller shaft generates a gap between the first roller and the corresponding second roller, the configuration according to Aspect A does not include any gap. As a result, a decrease in accuracy of the sheet thickness detection caused by the gap is no longer generated, thereby achieving the highly accurate sheet thickness detection.

Aspect B.

In Aspect A, the displacement amount detector (for example, the displacement sensor 61) is a contact-type displacement sensor (for example, a lever-type encoder sensor) having a moving body (for example, a detection arm 61*a*) that moves according to displacement of the first roller shaft (for example, the first driven roller shaft 473A) in the contact/separation direction, and a detecting part (for example, a detecting part 61*b*) that detects an amount of movement of the moving body.

Accordingly, the displacement amount detector can be provided in a simple configuration.

Aspect C.

In Aspect A, the displacement amount detector (for example, the displacement sensor 61) is a non-contact type displacement sensor (for example, an optical ranging sensor) that detects the amount of displacement of the first roller shaft (for example, the first driven roller shaft 473A) in the contact/separation direction without contacting the first roller shaft.

Accordingly, the amount of displacement of the first roller shaft can be detected without preventing displacement of the first roller shaft.

Aspect D.

In any one of Aspects A through C, the first roller shaft (for example, the first driven roller shaft 473A) is rotatably supported with respect to the first roller shaft holder (for example, the roller shaft holder 66), and the two first rollers (for example, the driven rollers 474*b* and 474*c*, and the driven rollers 474*d* and 474*e*) are fixed on the first roller shaft.

Accordingly, the configurations of the two first rollers and the first roller shaft can be simpler. It is to be noted that, when the displacement amount detector (for example, the displacement sensor 61) directly detects the amount of displacement of the first roller shaft, if the first roller shaft is fixedly (unrotatably) attached with respect to the first roller shaft holder, the first roller shaft detecting the amount of displacement does not rotate, thereby detecting a stable amount of displacement of the first roller shaft. Even when the first roller shaft is rotatably supported with respect to the first roller shaft holder, the displacement amount detector detects the amount of displacement of a bearing (for example, the bearings 68) that receives the first roller shaft. By so doing, the amount of displacement of the first roller shaft is detected indirectly. According to this configuration, since the bearing that is a detection target does not rotate, the amount of displacement of the first roller shaft can be detected reliably.

Aspect E.

In any one of Aspects A through D, the multiple second rollers (for example, the drive rollers 472*a* through 472*j*) are drive rollers that are fixed to a single third roller shaft of the at least one third roller shaft (for example, the drive roller shaft 471) and that rotate about the single third roller shaft along with rotation of the single third roller shaft, and the multiple first rollers are driven rollers that rotate with the multiple second rollers.

Accordingly, while the drive rollers are providing a conveying force to the sheet, the sheet thickness can be detected.

Aspect F.

In any one of Aspects A through E, the at least one third roller shaft (for example, the drive roller shaft 471) is invariable.

Accordingly, the sheet thickness can be determined based on the amount of displacement of the first roller shaft without considering the variation of the third roller shaft, and therefore much simpler sheet thickness detection can be achieved.

Aspect G.

In Aspect G, a sheet conveyor (for example, the sheet conveyor 600) has a configuration including a conveying force applier (for example, the sheet separation roller 45, the drive rollers 472*a* through 472*j*, the registration roller pair 49 and so forth) to apply a conveying force to the sheet to convey the sheet, the sheet thickness detector (for example, the conveying roller pairs 47, 147, and 247) to detect the thickness of the sheet conveyed with the conveying force applied by the conveying force applier, and a controller (for example, the controller 500) to control a sheet conveying operation according to a detection result obtained by the sheet thickness detector.

Accordingly, the sheet thickness can be detected with high accuracy. Therefore, the proper sheet conveying operation can be performed according to the different thicknesses of various types of sheets.

Aspect H.

In Aspect H, an image forming apparatus (for example, the image forming apparatus 1) has a configuration including an image forming device (for example, the toner image forming part 20) to form an image on the sheet, a conveying force applier (for example, the sheet separation roller 45, the drive rollers 472*a* through 472*j*, the registration roller pair 49 and so forth) to apply a conveying force to the sheet to convey the sheet, the sheet thickness detector (for example, the conveying roller pairs 47, 147, and 247) to detect the thickness of the sheet conveyed with the conveying force applied by the conveying force applier, and a controller (for example, the controller 500) to control a sheet conveying operation according to a detection result obtained by the sheet thickness detector.

Accordingly, the different thicknesses of various types of sheets can be detected with high accuracy. Therefore, the proper sheet conveying operation can be performed according to the different thicknesses of various types of sheets.

The above-described embodiments are illustrative and do not limit the present invention. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

What is claimed is:

1. A sheet thickness detector comprising:

multiple first rollers aligned in a direction perpendicular to a sheet conveying direction;

at least one second roller facing one of the respective multiple first rollers;

at least one third roller facing one of the respective multiple first rollers;

a first roller shaft configured to support the multiple first rollers;

a second roller shaft including two guide grooves, configured to support the at least one second roller;

a third roller shaft including two guide grooves, configured to support the at least one third roller;

a pair of biasing members configured to bias the second and third roller shafts toward the first roller shaft in a contact direction; and a displacement amount detector configured to detect an amount of displacement of the second roller shaft and in the contact direction, wherein the second roller shaft is rotatably supported by a roller shaft holder which is mounted on a stay, wherein the roller shaft holder includes a guide rib configured to fit into the two guide grooves of the second roller shaft, wherein the second and third roller shafts are separate and aligned co-axially with respect to each other;

wherein the multiple first rollers contact the at least one second roller and the at least one third roller to form nips therebetween, respectively, and wherein a thickness of a sheet held between the multiple first rollers and the at least one second roller and the at least one third roller is detected based on a detection result obtained by the displacement amount detector.

2. The sheet thickness detector according to claim 1, wherein the displacement amount detector is a contact-type displacement sensor comprising a moving body to move according to displacement of the second and third roller shafts in the contact direction; and a detecting part to detect an amount of movement of the moving body.

3. The sheet thickness detector according to claim 1, wherein the displacement amount detector is a non-contact type displacement sensor configured to detect the amount of displacement of at least one of the second roller shaft and the third roller shaft in the contact direction without contacting the second and third roller shafts.

4. The sheet thickness detector according to claim 1, wherein the second roller shaft is rotatably supported with respect to a roller shaft holder, and wherein the multiple first rollers are fixed on the first roller shaft.

5. The sheet thickness detector according to claim 1, wherein the multiple first rollers are drive rollers that are fixed to the first roller shaft and configured to rotate about a rotation axis of the first roller shaft, wherein the at least one second roller and the at least one third roller are driven rollers that rotate with the multiple first rollers.

6. The sheet thickness detector according to claim 1, wherein the first roller shaft is invariable.

7. A sheet conveyor comprising:

a conveying force applier configured to apply a conveying force to the sheet to convey the sheet;

the sheet thickness detector according to claim 1 configured to detect the thickness of the sheet conveyed with the conveying force applied by the conveying force applier; and a controller configured to control a sheet conveying operation according to a detection result obtained by the sheet thickness detector.

8. An image forming apparatus comprising:

an image forming device configured to form an image on the sheet;

a conveying force applier configured to apply a conveying force to the sheet to convey the sheet;

the sheet thickness detector according to claim 1 configured to detect the thickness of the sheet conveyed with the conveying force applied by the conveying force applier; and a controller configured to control a sheet conveying operation according to a detection result obtained by the sheet thickness detector.

9. The sheet thickness detector according to claim 1, further comprising a roller shaft holder configured to support the second roller shaft to move from the first roller shaft in a contact direction.

10. The sheet thickness detector according to claim 1, wherein the stay is configured to extend between the multiple first rollers and the at least one second roller and the at least one third roller.

11. The sheet thickness detector according to claim 1, wherein the two guide grooves in the second roller shaft and the third roller shaft have respective cutout portions arranged to extend in parallel in a direction perpendicular to an axial direction of at least one of the second roller shaft and the third roller shaft.

12. The sheet thickness detector according to claim 1, wherein the displacement amount detector is fixed to the stay.

13. The sheet thickness detector according to claim 1, wherein a total number of the multiple first rollers is equal to a combined total number of the second roller and the third roller.

14. The sheet thickness detector according to claim 1, wherein the guide groove is a notch in the second roller shaft and arranged to extend in parallel in a direction perpendicular to an axial direction of the first roller shaft.

15. The sheet thickness detector according to claim 14, wherein the first roller shaft is supported by a roller shaft holder.

* * * * *